US007722434B2

(12) United States Patent
Mundt

(10) Patent No.: US 7,722,434 B2
(45) Date of Patent: May 25, 2010

(54) APPARATUS FOR MEASUREMENT OF PARAMETERS IN PROCESS EQUIPMENT

(75) Inventor: Randall S. Mundt, Pleasanton, CA (US)

(73) Assignee: KLA-Tencor Corporation, San Jose, CA (US)

( * ) Notice: Subject to any disclaimer, the term of this patent is extended or adjusted under 35 U.S.C. 154(b) by 903 days.

(21) Appl. No.: 11/392,220

(22) Filed: Mar. 28, 2006

(65) Prior Publication Data

US 2007/0243794 A1 Oct. 18, 2007

Related U.S. Application Data

(60) Provisional application No. 60/666,527, filed on Mar. 29, 2005.

(51) Int. Cl.
*B24B 49/00* (2006.01)

(52) U.S. Cl. ..... 451/5; 451/10; 451/11; 438/6; 257/E29.324

(58) Field of Classification Search ..... 451/5, 451/8, 10, 11; 438/5, 6; 257/415, E29.324
See application file for complete search history.

(56) References Cited

U.S. PATENT DOCUMENTS

| | | | | |
|---|---|---|---|---|
| 5,865,666 | A * | 2/1999 | Nagahara | 451/10 |
| 5,916,009 | A * | 6/1999 | Izumi et al. | 451/5 |
| 6,010,538 | A | 1/2000 | Sun et al. | |
| 6,012,336 | A * | 1/2000 | Eaton et al. | 73/754 |
| 6,072,313 | A * | 6/2000 | Li et al. | 324/230 |
| 6,352,466 | B1 * | 3/2002 | Moore | 451/5 |
| 6,494,765 | B2 | 12/2002 | Gitis et al. | |
| 6,542,835 | B2 * | 4/2003 | Mundt | 702/65 |
| 6,612,900 | B2 | 9/2003 | Moore | |
| 6,626,734 | B2 | 9/2003 | Moore | |
| 6,642,853 | B2 | 11/2003 | Hunter | |
| 6,691,068 | B1 | 2/2004 | Freed et al. | |
| 6,696,005 | B2 | 2/2004 | Strasbaugh | |
| 6,702,647 | B2 | 3/2004 | Moore | |
| 6,722,948 | B1 * | 4/2004 | Berman | 451/21 |
| 6,726,528 | B2 | 4/2004 | Barbour | |
| 6,736,698 | B2 | 5/2004 | Moore | |
| 6,739,945 | B2 | 5/2004 | Halley et al. | |

(Continued)

FOREIGN PATENT DOCUMENTS

JP 2006126182 A * 5/2006

(Continued)

OTHER PUBLICATIONS

U.S. Appl. No. 60/530,682, filed Dec. 17, 2003.

(Continued)

*Primary Examiner*—Eileen P. Morgan
(74) *Attorney, Agent, or Firm*—Joshua D. Isenberg; JDI Patent

(57) ABSTRACT

Some problems related to processing workpieces are presented along with solutions to one or more of the problems. One embodiment of the invention comprises a sensor apparatus for collecting data representing one or more process conditions used for processing a workpiece. Another embodiment of the present invention is a combination comprising a sensor apparatus and a process tool for applications such as chemical mechanical planarization of workpieces and chemical mechanical polishing of workpieces.

33 Claims, 8 Drawing Sheets

U.S. PATENT DOCUMENTS

| | | | | |
|---|---|---|---|---|
| 6,780,082 | B2 | 8/2004 | Moore | |
| 7,127,362 | B2 * | 10/2006 | Mundt | 702/56 |
| 7,153,182 | B1 * | 12/2006 | Taylor et al. | 451/5 |
| 2002/0052052 | A1 * | 5/2002 | Robinson et al. | 438/5 |
| 2003/0188829 | A1 | 10/2003 | Rangarajan et al. | |
| 2004/0154417 | A1 | 8/2004 | Renken et al. | |
| 2004/0225462 | A1 | 11/2004 | Renken et al. | |
| 2005/0246127 | A1 | 11/2005 | Renken et al. | |
| 2006/0070449 | A1 * | 4/2006 | Yokoyama et al. | 73/754 |
| 2007/0262401 | A1 * | 11/2007 | Yokoyama et al. | 257/415 |

FOREIGN PATENT DOCUMENTS

| | | |
|---|---|---|
| WO | WO2005/091359 | 9/2005 |

OTHER PUBLICATIONS

U.S. Appl. No. 11/179,440, filed Jul. 11, 2005, Inventors: MacDonald et al.
U.S. Appl. No. 60/285,439, filed Apr. 19, 2001, Inventors: Freed et al.
U.S. Appl. No. 60/666,527, filed Mar. 29, 2005, Inventors: Mundt.

* cited by examiner

APPARATUS FOR MEASUREMENT OF PARAMETERS IN PROCESS EQUIPMENT

CROSS REFERENCES

The present application claims benefit of U.S. Patent Application Ser. No. 60/666,527, filed 29 Mar. 2005, inventor (s) Randall S. MUNDT. The present application is related to U.S. Pat. No. 6,691,068, filed 22 Aug. 2000; U.S. Patent Application Ser. No. 60/530,682, filed 17 Dec. 2003; and U.S. patent application Ser. No. 10/775,044, filed 9 Feb. 2004, pending. The contents of U.S. Patent Application Ser. No. 60/666,527, U.S. Patent Application Ser. No. 60/530,682, U.S. patent application Ser. No. 10/775,044, filed and U.S. Pat. No. 6,691,068, are incorporated herein, in their entirety, by this reference.

FIELD

Embodiments of the present invention generally relate to an apparatus for measuring parameters such as spatially and/or temporally varying process conditions applied to a substantially planar work piece during a manufacturing operation. More specifically, this invention relates to the measurement of process parameter distributions and/or trajectories occurring during processes such as Chemical Mechanical Planarization (CMP) processes and polishing processes such as those used in the production of semiconductor devices.

BACKGROUND

The fabrication of a semiconductor device often requires that a suitable workpiece (e.g. a silicon wafer) be subjected to a sequence of discrete process operations. Many of these processes are very sensitive to the process conditions and are preferably carried out within individual process chambers or work cells, often referred to as process tools, within which very specific conditions are established. Modern semiconductor processing equipment typically utilizes robotic transfer mechanisms to move silicon wafers into and out of these work cells.

The ability to establish and maintain precise conditions within a work cell accurately and reproducibly is needed for the successful production of some of the state-of-the-art silicon devices. In order to achieve the high device yields necessary for commercial success, the conditions within a process chamber are continuously monitored and controlled through the use of sensors designed to measure specific physical parameters. Typically, these control sensors are built into the process tool and measure the parameter of interest (e.g. pressure) at a specific location within the work cell.

As larger work pieces are adopted (e.g. 300 mm diameter silicon wafers), and as the design feature sizes decrease (e.g., 0.13 um transistor gate widths), it becomes important to have each point on the surface of the workpiece processed under optimum process conditions. Measurement of a parameter (e.g. temperature) at an arbitrarily selected point within the work cell may not be adequate to achieve and maintain optimal device yields and performance characteristics. A new type of sensor has been developed to address the need for monitoring process conditions at the work piece surface: U.S. Pat. No. 6,542,835 and U.S. Pat. No. 6,691,068 describe such a sensor system.

Typically, CMP processing is accomplished by pressing the front side (device side) of the semiconductor wafer against a compliant pad. Usually, a liquid solution is introduced between the pad and the wafer. This solution typically contains etching materials and abrasive particles. In some CMP systems, the abrasive particles are preloaded onto and/or into the surface of the compliant pad. By moving the wafer with respect to the pad, material is removed from the surface of the wafer by a combination of chemical etching and mechanical abrasion. Careful control of physical parameters such as contact pressure, slurry composition, surface velocity, pad compliance, etc. results in protrusions on the wafer surface (high spots) being removed at a greater rate than the bulk of the wafer surface. This selective removal of material from the high spots results in the wafer being planarized or flattened. This planarization process is useful in eliminating the uneven surface topology caused by the repeated deposition and patterning (photolithography) steps required to fabricate an integrated circuit.

A second application of CMP processing is in the production of conductive lines or traces via the damascene process. In this process, trenches are etched into an insulator material deposited on the surface of semiconductor wafers. A layer of a conductive material (typically copper) is then deposited or plated onto the wafer surface so as to completely fill the trenches. A CMP process is then used to polish or remove the deposited material back to the original insulator surface, leaving the conductive material filling the trenches.

The quality of the CMP process in terms of removal rates, uniformity, selectivity, etc., is strongly affected by a number of the process variables; the pressure or force with which the wafer or other workpiece is pressed against the pad during the process being a critical factor. Consequently, there is a need for accurate knowledge of the localized pressure distributions (spatial mapping) during actual process conditions. Furthermore, there is a need for methods and apparatus for measuring the evolution of the pressure distributions over time (trajectory); this would provide a valuable tool for optimizing and maintaining CMP processes and process tools.

SUMMARY

This invention seeks to provide solutions to one or more of the problems related to processing the surface of workpieces. One aspect of the invention comprises a sensor apparatus for collecting data representing process conditions used for processing a workpiece. A second aspect of the present invention is a combination comprising a sensor apparatus and a process tool. A third aspect of the present invention comprises a method of operating and maintaining a process tool.

It is to be understood that the invention is not limited in its application to the details of construction and to the arrangements of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out aspects of the present invention. It is important, therefore, that the claims be regarded as including such equivalent constructions insofar as they do not depart from the spirit and scope of the present invention.

The above and still further features and advantages of the present invention will become apparent upon consideration of the following detailed descriptions of specific embodiments thereof, especially when taken in conjunction with the accompanying drawings.

Figure 1A:
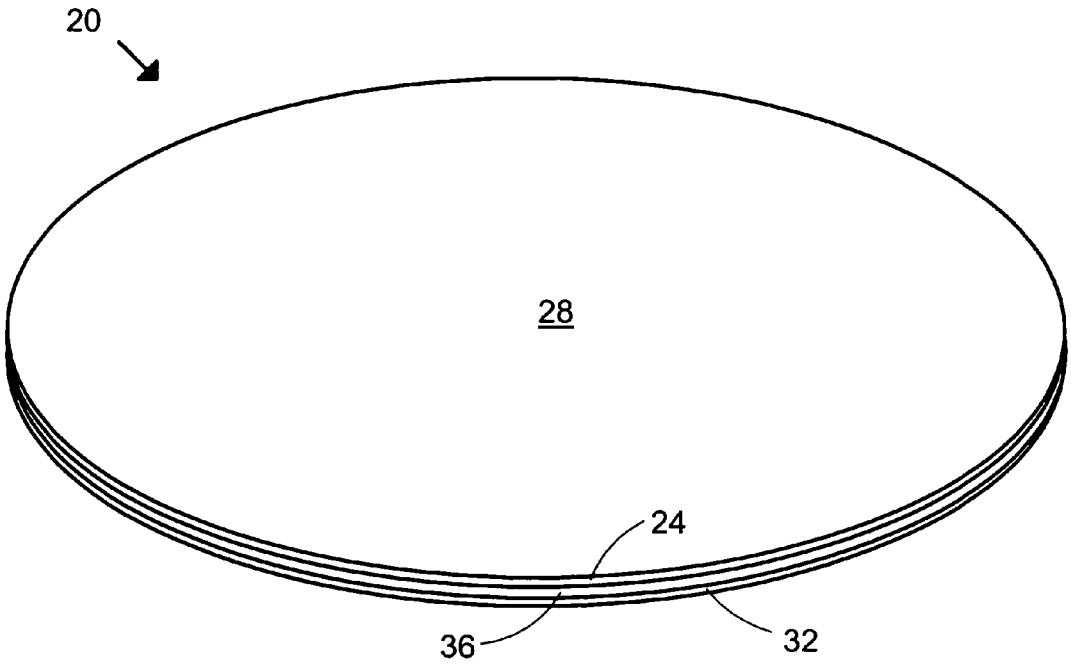
FIG. 1A is a perspective view of an embodiment of the present invention.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DESCRIPTION

The present invention pertains to methods, apparatuses, and systems for processing workpieces. The operation of embodiments of the present invention will be discussed below, primarily in the context of processing semiconductor wafers. Embodiments of the present invention and operation of embodiments of the present invention will be discussed below, primarily in the context of measuring and collecting data for a condition of a process such as pressure data, such as temperature data, and such as pressure and temperature data for pressure sensitive processes such as those used for processing semiconductor wafers for fabricating electronic devices. Examples of some of the pressure sensitive processes for which embodiments of the present invention are suitable are polishing, buffing, cleaning, chemical mechanical planarization, and chemical mechanical polishing. The embodiments presented below describe methods, apparatuses, and systems configured so as to be capable of accurately and reproducibly measuring at least one of: (1) pressure distributions and temperature distributions, (2) pressure trajectories and temperature trajectories, (3) pressure distributions, (4) pressure trajectories, (5) temperature distributions, (6) temperature trajectories, (7) temperatures, and (8) pressures for a typical chemical mechanical planarization process. However, it is to be understood that embodiments in accordance with the present invention are not limited to semiconductor wafer processing nor are embodiments of the present invention limited to the measurement of temperature, the measurement of pressure, or the measurement of temperature and pressure. Furthermore, embodiments of the present invention can be used for substantially any application that involves pressure sensitive processes for processing the surface of a workpiece.

In the following description of the figures, identical reference numerals have been used when designating substantially identical elements or steps that are common to the figures.

Figure 1B:
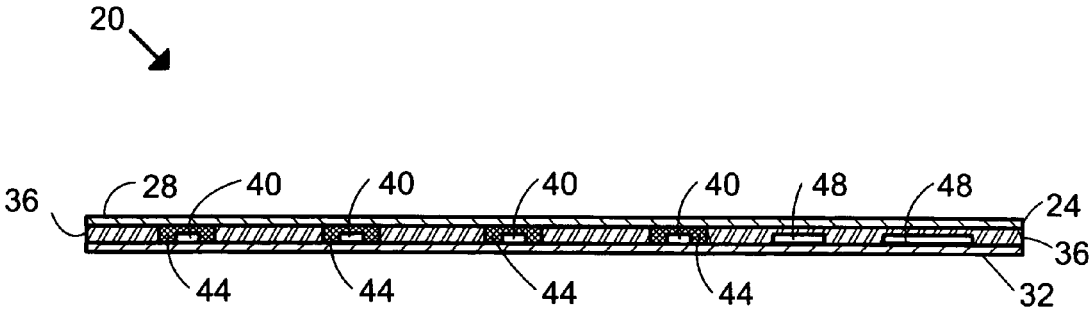
FIG. 1B is a cross-section side view of the embodiment of the present invention shown in FIG. 1A.

Reference is now made to FIG. 1A where there is shown a perspective view of a sensor apparatus 20 according to one embodiment of the present invention and to FIG. 1B where there is shown a cross-section side view of sensor apparatus 20. Sensor apparatus 20 is configured for measuring pressure or force distributions experience by a semiconductor wafer during chemical mechanical polishing or planarization processes for fabricating electronic devices. Sensor apparatus 20 is also configured for measuring pressure or force trajectories. Sensor apparatus 20 includes a contact plate 24 having a contact surface 28; contact plate 24 has a backside opposite contact surface 28. Sensor apparatus 20 further includes a base 32 and a spacer 36. FIG. 1A and FIG. 1B show spacer 36 sandwiched between contact plate 24 and base 32. Sensor apparatus 20 also includes at least one sensor 40, preferably, more than one sensor 40. Sensor 40 is configured for measuring one or more process conditions. In one embodiment of the present invention, sensor 40 may be configured for measuring pressure. In another embodiment of the present invention, sensor 40 may be configured for measuring temperature. A preferred embodiment of the present invention includes a plurality of sensors for the at least one sensor 40 and the plurality of sensors includes different types of sensors for measuring dissimilar process conditions such as temperature and pressure.

For applications of measuring pressure or force, the sensor 40 comprises a pressure sensor or a force sensor for measuring pressure or force applied to contact surface 28. FIG. 1B shows one of the possible configurations for the position of sensor 40 in sensor apparatus 20. For the embodiment shown in FIG. 1B, spacer 36 has a hole for each sensor 40 that surrounds each sensor 40. Preferred embodiments of sensor apparatus 20 also include a filler 44 that fills the excess volume of the hole surrounding each sensor 40 so as to substantially eliminate voids around each sensor 40. Optionally, filler 44 may comprise substantially the same material used for the material of spacer 36. A preferred embodiment of the present invention includes using the same material for filler 44 and spacer 36. The location of sensor 40 and the application of filler 44 are arranged so as to allow pressure applied to contact surface 28 to be transferred to sensor 40. In other words, sensor 40 is connected with contact plate 24 so that pressure or force can be transferred from contact surface 28 to sensor 40.

It is to be understood that a direct connection between sensor 40 and contact plate 24 is not required, i.e., the pressure transfer can be made indirectly through another medium such as through filler 44. In other words, filler 44 functions as a force-transmitting medium for pressure measurements or force measurements. In view of the present disclosure, additional embodiments of the present invention having other possible configurations for sensor 40, filler 44, base 32, and contact plate 24 will be clear to a person of ordinary skill in the art.

Sensor apparatus 20 further includes one or more electronics component 48. Preferred embodiments of the present invention typically use more than one electronics component 48. Electronics component 48 is also sandwiched between contact plate 24 and base 32. Preferably, spacer 36 is configured so as to fit around electronics component 48 to substantially eliminate voids. Optionally, spacer 36 may be configured so as to have recessed areas or holes to fit around electronics component 48.

Electronics components 48 are configured for receiving data from sensors 40. In other words, electronics components 48 are coupled to sensors 40 to receive data for the pressure or force measurements made by sensors 40. Electronics components 48 are configured for receiving information and, in preferred embodiments, also processing information, storing information, transmitting information, and executing computer commands. Preferably, electronics components 48 include an information processor for executing commands and processing data from the sensors. Some examples of suitable information processors are information processors such as a microprocessor, an application-specific integrated circuit, and a computer. Electronics components 48 further include additional supporting devices to allow the information processor to function. Some of the additional supporting devices include a power source such as a battery or other energy storage device, a transmitter and/or a receiver, and an information storage device such as a memory. In preferred embodiments of the present invention, electronics components 48 are configured for wireless information transfer. A detailed description of suitable electronic components and configurations for the electronic components for embodiments of the present invention can be found in U.S. Pat. No. 6,691,068 and U.S. Pat. No. 6,542,835.

Preferably, the external surfaces of sensor apparatus 20 comprise semiconductor grade materials so that the materials are compatible with a semiconductor wafer processing equipment. The measurement of pressure or force distributions using sensor apparatus 20 involves contacting a chemical mechanical polishing pad with contact surface 28 during conditions used for chemical mechanical polishing or planarization processes. Spatially resolved pressure measurements for contact surface 28 can be measured by sensors 40 and the measurement data are transmitted to electronics components 48 for one or more of processing information, storing information, and transmitting the information.

Preferred embodiments of the present invention are suitable for obtaining the most useful information when the embodiment is configured to have properties similar to those of the workpiece. For the application of semiconductor wafer processing, this means that sensor apparatus 20 should have some of the important properties of the semiconductor wafers for which the CMP process is used. Specifically, for the most preferred embodiments of the present invention, the material in contact with the polishing pad mimics the mechanical and chemical properties of the surface of the workpiece for which the process is used.

For preferred embodiments, sensor apparatus 20 is configured so that the dimensions and shape of the sensor apparatus approximate the dimensions and other important mechanical characteristics of a workpiece. For applications of semiconductor wafer processing, this means that sensor apparatus 20 has the shape and approximate dimensions of a semiconductor wafer. Preferably, sensor apparatus 20 is substantially circular and has a diameter approximately equal to that of the semiconductor wafer. Of particular importance for measurement of pressure and forced distributions are the mechanical properties of the sensor apparatus 20. This means that the sensor apparatus should develop and measure a pressure distribution that is substantially equivalent to that of the semiconductor wafer or other workpiece. Preferred embodiments of sensor apparatus 20 are designed so that sensor apparatus 20 has about the same mechanical stiffness as that of the workpiece for which the process is used. More specifically for silicon wafer processing, sensor apparatus 20 is designed so as to have approximately the same mechanical stiffness as the silicon wafers for which the CMP process is applied.

The desired mechanical stiffness is achieved through proper selection of the materials used and the dimensions, such as thickness, of the materials used in fabricating sensor apparatus 20. In one embodiment of the present invention, contact plate 24 is configured so that it provides most of the mechanical stiffness for sensor apparatus 20. The remaining components including spacer 36 and base 32 are configured so that they contribute a smaller amount to the mechanical stiffness so that the total mechanical stiffness for sensor apparatus 20 approximates the mechanical stiffness of the workpiece.

Of further importance for preferred embodiments of the present invention is that sensor apparatus 20 is configured so that it can be used in a substantially non-intrusive manner. This means that the apparatus should not cause significant chemical contamination of the process tool for which the measurements are being made. The apparatus should have dimensions so that the apparatus can be loaded and unloaded to and from the process tool in substantially the same way that the semiconductor wafer or other workpiece is loaded and unloaded. Since most modern semiconductor processing facilities and equipment use robotic systems for loading and unloading wafers, this means that sensor apparatus 20 is preferably configured so that it can be accommodated by the robotic systems used for loading and unloading semiconductor wafers for CMP processing. In other words, preferred embodiments of the sensor apparatus are configured so as to measure pressure distributions and trajectories under actual processing conditions and substantially without modifications to or perturbations of the processing equipment.

For preferred embodiments of sensor apparatus 20, contact surface 28 comprises a material that is semiconductor grade and is compatible with polishing and/or planarization processes for semiconductor substrates. Preferably, contact plate 24 comprises a material used in the fabrication of integrated circuits. Contact plate 24 has contact surface 28 to serve as a contact side for undergoing at least one of planarization processes and polishing processes.

For some embodiments, contact plate 24 comprises a sheet of tungsten, a sheet of aluminum alloy, a sheet of silicon dioxide, a sheet of boron phosphorous silicate glass, a sheet of fluorine doped silicon dioxide, a sheet of diamond like carbon, a sheet of diamond, a sheet of carbon doped silicon dioxide, a sheet of silicon, a sheet of fused silica, a sheet of quartz, a sheet of borosilicate glass, a sheet of alumina, a sheet of sapphire, or a sheet of a low dielectric constant silicon compound. Alternatively, contact plate 24 can be configured to comprise a supported layer of tungsten, a supported layer of aluminum alloy, a supported layer of silicon dioxide, a supported layer of boron phosphorous silicate glass, a supported layer of fluorine doped silicon dioxide, a supported layer of diamond like carbon, a supported layer of diamond, a supported layer of carbon doped silicon dioxide, a supported layer of silicon, a supported layer of fused silica, a supported layer of quartz, a supported layer of borosilicate glass, a supported layer of alumina, a supported layer of sapphire, or a supported layer of a low dielectric constant silicon compound. Generally, contact plate 24 may comprise a sheet of metal, a sheet of dielectric, or a sheet of semiconductor. In one embodiment, contact plate 24 comprises a substantially whole semiconductor wafer such as a whole silicon wafer. In one embodiment of sensor apparatus 20, contact surface 28 comprises copper. In another embodiment of sensor apparatus 20, contact surface 28 comprises a material having a dielectric constant less than about 2.1.

In a preferred embodiment, contact surface 28 is substantially smooth and substantially flat. As an option for some embodiments of the present invention, contact surface 28 is patterned with a surface topography. Preferably, the surface topography is substantially similar to the surface topography of the workpiece semiconductor wafer.

Spacer 36 comprises a flexible and substantially incompressible material such as a rubber like material such as an organic polymer. The thickness of this spacer material is selected based upon the thickness of electronic components 48. In this embodiment, the spacer comprises a polyurethane polymer.

Sensor apparatus 20 further includes having contact plate 24, spacer 36, and base 32 bonded together to form a single unit. A preferred embodiment of sensor apparatus 20 includes using an adhesive to bond the backside of contact plate 24 to a spacer 36 and using an adhesive to bond spacer 36 to base 32. In other words, the embodiment shown in FIG. 1A is held together using an adhesive. In view of the present disclosure, it will be clear to those of ordinary skill in the art how to configure other embodiments of the present invention using bonding methods other than adhesive bonding.

For sensor apparatus 20, filler 44 is present in the cavities surrounding the sensors elements. In preferred embodiments, filler 44 comprises a liquid like gel material. For pressure measurement applications, the function of the liquid-like gel material is to efficiently and accurately transmit pressure applied to contact plate 24 to pressure sensors 40. It is a specific feature of a preferred embodiment of the present invention that the liquid-like gel material and cavity filling method are optimized to provide for stable, hysterisis free communication of pressure between contact plate 24 and pressure sensors 40. Filling the cavity surrounding the pressure sensors with the gel material eliminates bubbles that can degrade the accuracy of the pressure measurements. Although the use of the gel material is preferred, other materials can be used instead of the gel material. Examples of other materials that can be used include incompressible liquids and incompressible solids.

In a preferred embodiment, base 32 comprises a substantially continuous plate that serves to seal the back and complete the sensor apparatus. When sensor apparatus 20 is used for taking pressure or force measurements during a CMP process, base 32 will typically contact the wafer carrier. The wafer carrier typically includes a chuck or other wafer holding equipment for pressing the wafer to a CMP pad. Of course, for the pressure measurements, the wafer carrier holds sensor apparatus 20 so that contact surface 28 contacts the CMP pad. Base 32 may be exposed to the chemical environment of the CMP process and should be fabricated of a suitable material that will not be substantially corroded by the CMP process. It is also important that the material not cause significant contamination of the CMP process. In one embodiment, base 32 comprises a sheet of polymer.

Figure 2A:
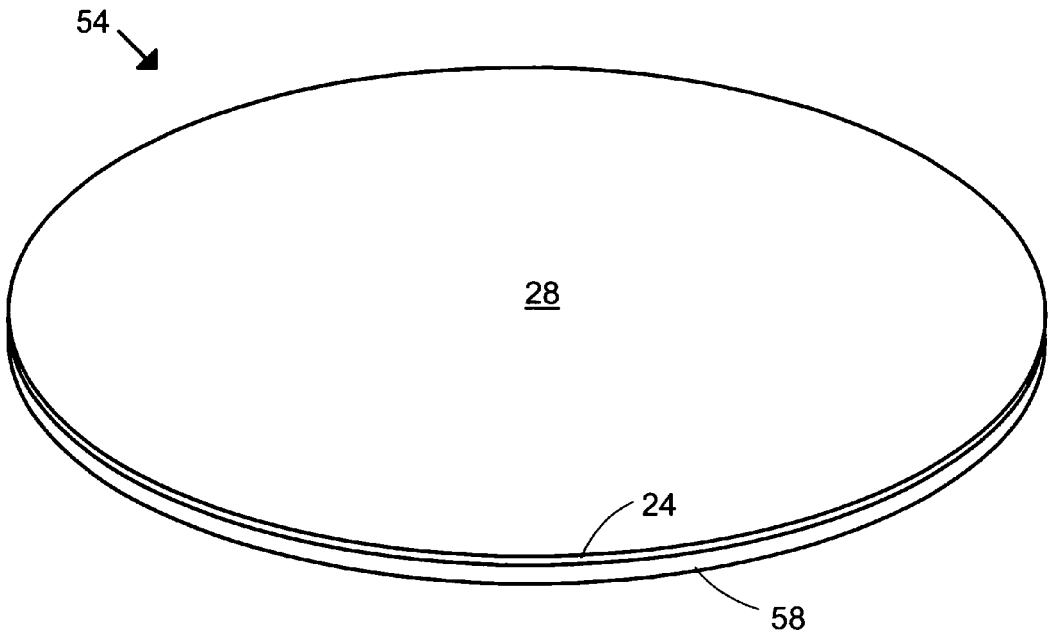
FIG. 2A is a perspective view of an embodiment of the present invention.
Figure 2B:
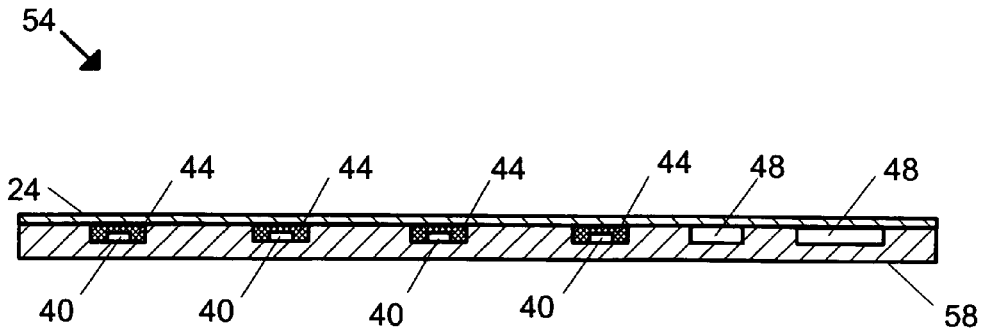
FIG. 2B is a cross-section side view of the embodiment of the present invention shown in FIG. 2A.

Reference is now made to FIG. 2A where there is shown a perspective view of a sensor apparatus 54 according to another embodiment of the present invention and to FIG. 2B where there is shown a cross-section side view of sensor apparatus 54. Sensor apparatus 54 is configured for measuring pressure or force distributions experience by a semiconductor wafer during chemical mechanical polishing or planarization processes for fabricating electronic devices. Sensor apparatus 54 includes a contact plate 24 having a contact surface 28 that is essentially the same as that for the embodiment described for FIG. 1A and FIG. 1B. Sensor apparatus 54 further includes a base 58.

Sensor apparatus 54 also includes at least one sensor 40, filler 44, and at least one electronics component 48. Sensor 40, filler 44, and electronics component 48 are essentially the same as those described for the embodiment described for FIG. 1A and FIG. 1B with the exception that they are now used with base 58. Base 58 is a substantially continuous solid plate having recessed areas or wells formed therein. The recessed areas are sized and placed so that they can hold the sensor or sensors 40 and electronics component 48. Filler 44 is used to fill the excess volume around sensors 40 in the recessed areas. The recessed areas for electronic components 48 are preferably closely fitted so that there is substantially no excess volume.

It is to be understood that the sensor apparatus 54 is to be configured with contact plate 24, contact surface 28, sensors 40, filler 44, and electronic components 48 having essentially the same options for the functions, preferences, and properties as those described for sensor apparatus 20.

Figure 3A:
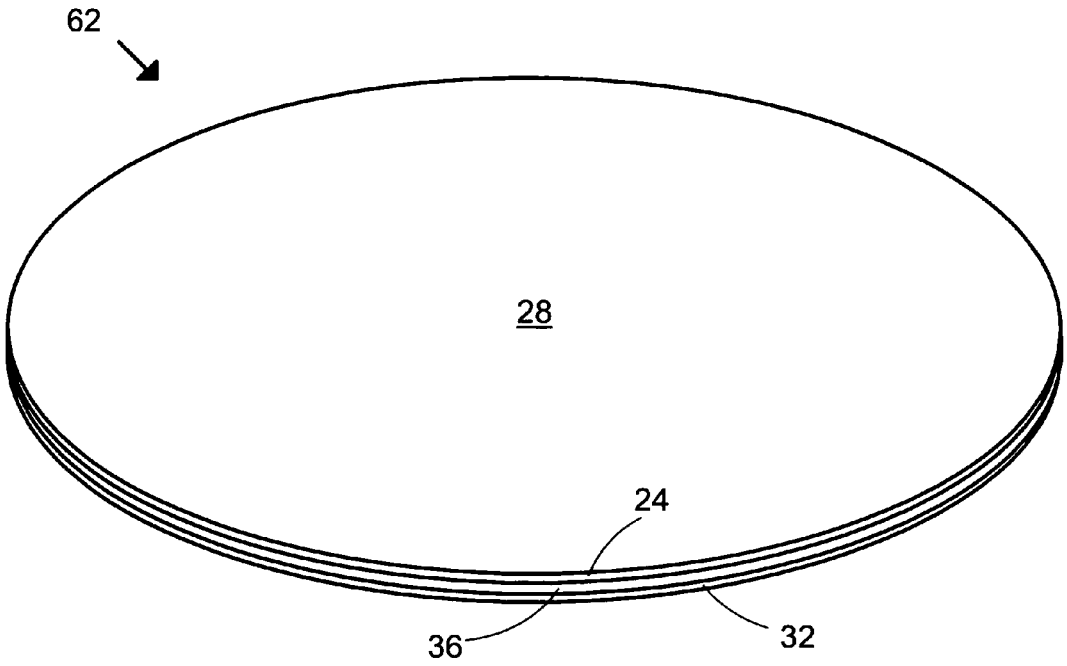
FIG. 3A is a perspective view of an embodiment of the present invention.
Figure 3B:
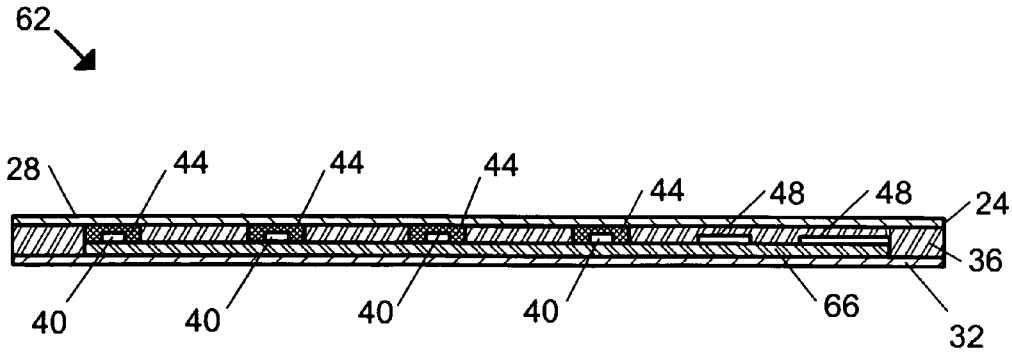
FIG. 3B is a cross-section side view of the embodiment of the present invention shown in FIG. 3A.

Reference is now made to FIG. 3A where there is shown a perspective view of a sensor apparatus 62 according to another embodiment of the present invention and to FIG. 3B where there is shown a cross-section side view of sensor apparatus 62. Sensor apparatus 62 is configured for measuring pressure or force distributions experienced by a semiconductor wafer during chemical mechanical polishing or planarization processes for fabricating electronic devices. Sensor apparatus 62 includes a contact plate 24 having a contact surface 28, a spacer 36, and a base 32 that are essentially the same as those for the embodiment described for FIG. 1A and FIG. 1B.

Sensor apparatus 62 further includes at least one sensor 40, filler 44, and at least one electronics component 48. Sensor 40, filler 44, and electronics component 48 are essentially the same as those described for the embodiment described for FIG. 1A and FIG. 1B. FIG. 3B further shows that sensor apparatus 62 includes a printed circuit board 66 interconnecting the at least one sensor 40 and the at least one electronics component 48. Printed circuit board 66 is sandwiched between contact plate 24 and base 32. Spacer 36 and filler 44 are provided in sensor apparatus 62 in substantially the same way as described for the embodiment shown in FIG. 1A and FIG. 1B. For the embodiment shown in FIG. 3B, printed circuit board 66 is designed to have a diameter slightly less than the diameter of contact plate 24 and base 32 so that the edge of sensor apparatus 62 does not expose printed circuit board 66 to the process chemistry.

Figure 3C:
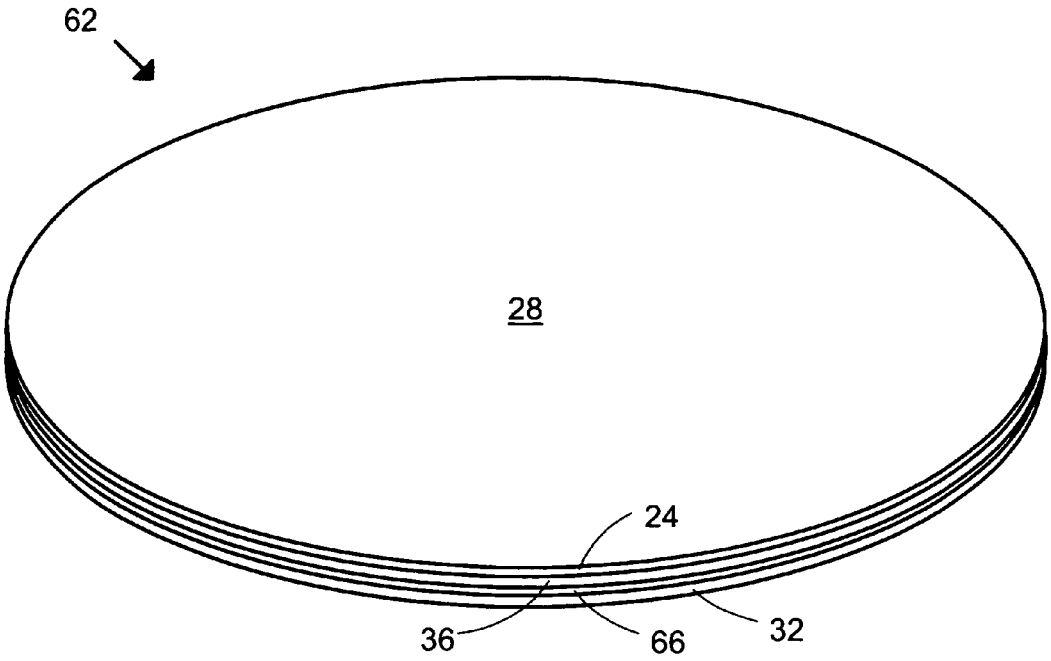
FIG. 3C is a perspective view of an embodiment of the present invention.
Figure 3D:
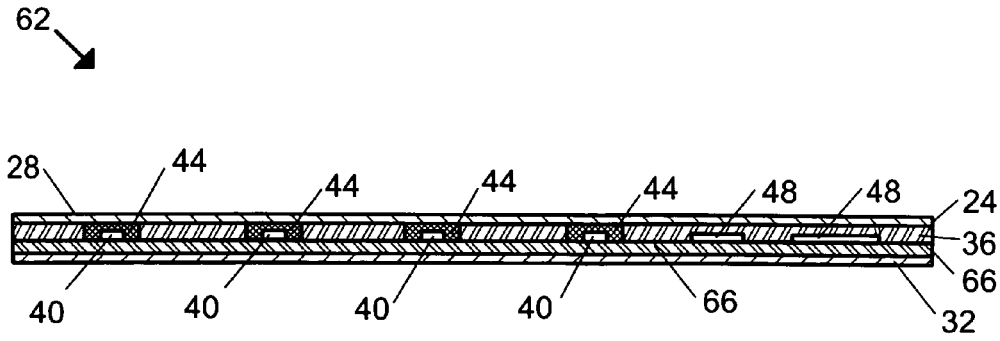
FIG. 3D is a cross-section side view of the embodiment of the present invention shown in FIG. 3C.

Reference is now made to FIG. 3C and FIG. 3D where there is shown a sensor apparatus 62 that is essentially the same as the sensor apparatus 62 shown in FIG. 3A and FIG. 3B with the exception that printed circuit board 66 has a diameter that substantially equals the diameter of contact plate 24 and base 32. In other words, this embodiment has the outer edges of printed circuit board 66 exposed at the edge of sensor apparatus 62.

Figure 3E:
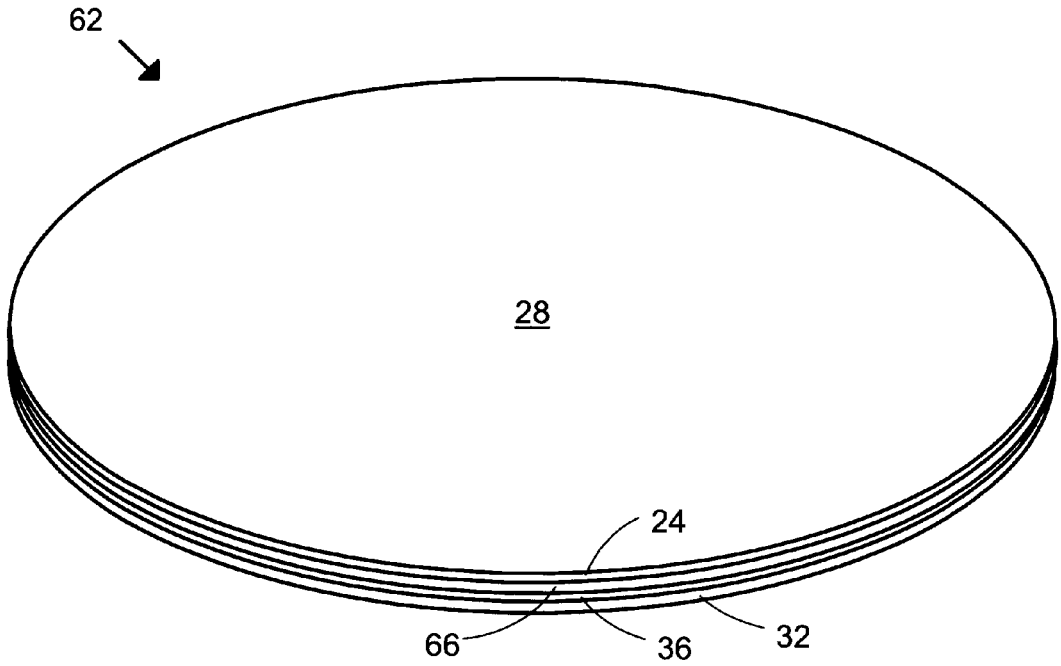
FIG. 3E is a perspective view of an embodiment of the present invention.
Figure 3F:
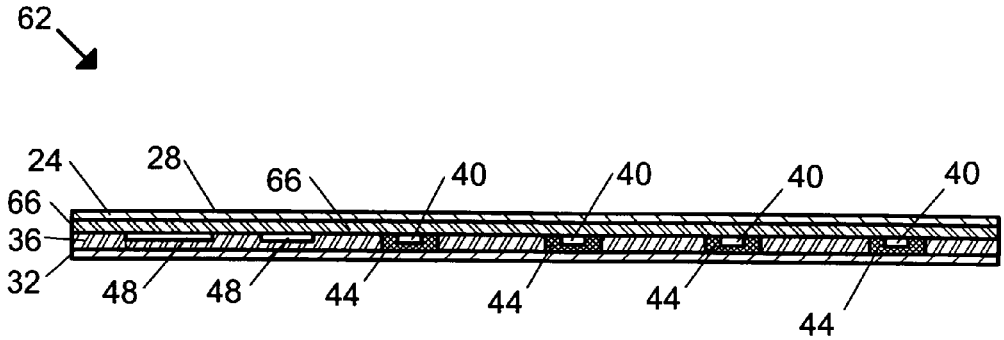
FIG. 3F is a cross-section side view of the embodiment of the present invention shown in FIG. 3E.

Reference is now made to FIG. 3E and FIG. 3F where there is shown a sensor apparatus 62 that is essentially the same as the sensor apparatus 62 shown in FIG. 3C and FIG. 3D with the exception that the location of contact plate 24 and base 32 have been exchanged. In other words, contact plate 24 is bonded to the backside of printed circuit board 66. The front side of printed circuit board 66 has sensors 40 and electronics component 48 integrated thereon; the front side of printed circuit board 66 contacts spacer 36. Base 32 contacts spacer 36. Filler 44 fills the space surrounding sensor 40 between printed circuit board 66 and base 32.

The functions of sensor apparatus 62 shown in FIG. 3D and FIG. 3F are essentially the same with respect to providing measurements of pressure or force applied to contact plate 24.

In a preferred embodiment, sensor apparatus 62 shown in FIG. 3F further comprises an adhesive between the backside of contact plate 24 and printed circuit board 66. The adhesive is applied so as to affix printed circuit board 66 to contact plate 24. Printed circuit board 66 has a through hole proximate to each sensor 40 (the through hole is not shown in FIG. 3F). The through hole is capable of providing fluid communication between contact plate 24 and sensor 40. In a more preferred embodiment, filler 44 is used to fill the volume surrounding the each sensor 40 and the through hole to further improve the transmission of pressure from the contact plate to the sensors.

Preferably, the adhesive between the backside of contact plate 24 and printed circuit board 66 comprises a removable adhesive. The removable adhesive is applied so as to detachably affix printed circuit board 66 to contact plate 24.

Figure 3G:
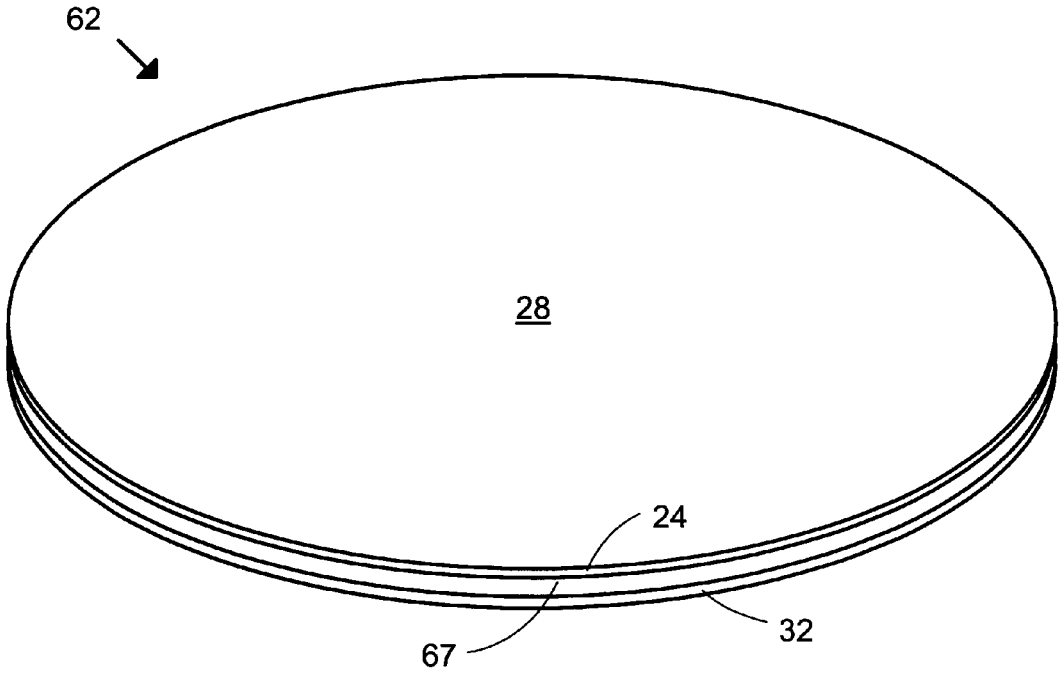
FIG. 3G is a perspective view of an embodiment of the present invention.
Figure 3H:
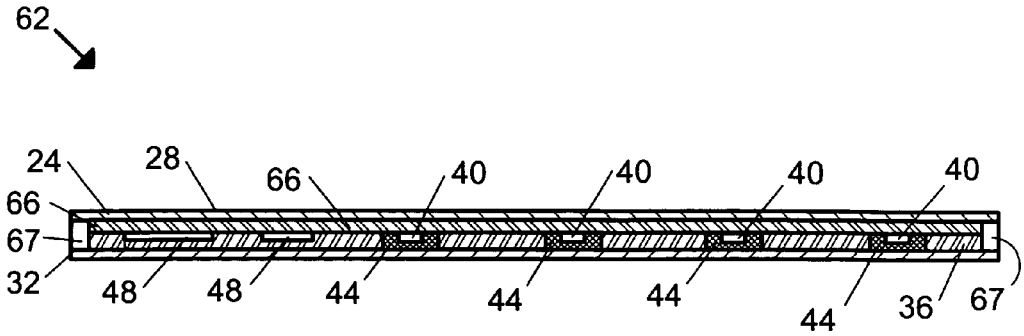
FIG. 3H is a cross-section side view of the embodiment of the present invention shown in FIG. 3G.

Reference is now made to FIG. 3G and FIG. 3H where there is shown a sensor apparatus 62 that is essentially the same as the sensor apparatus 62 shown in FIG. 3E and FIG. 3F with the exception that the embodiment shown in FIG. 3G and FIG. 3H further comprises an edge seal 67. Edge seal 67 comprises a substantially inert and substantially impermeable material for preventing spacer 36 and printed circuit board 66 from exposure to the CMP process chemicals.

Figure 4:
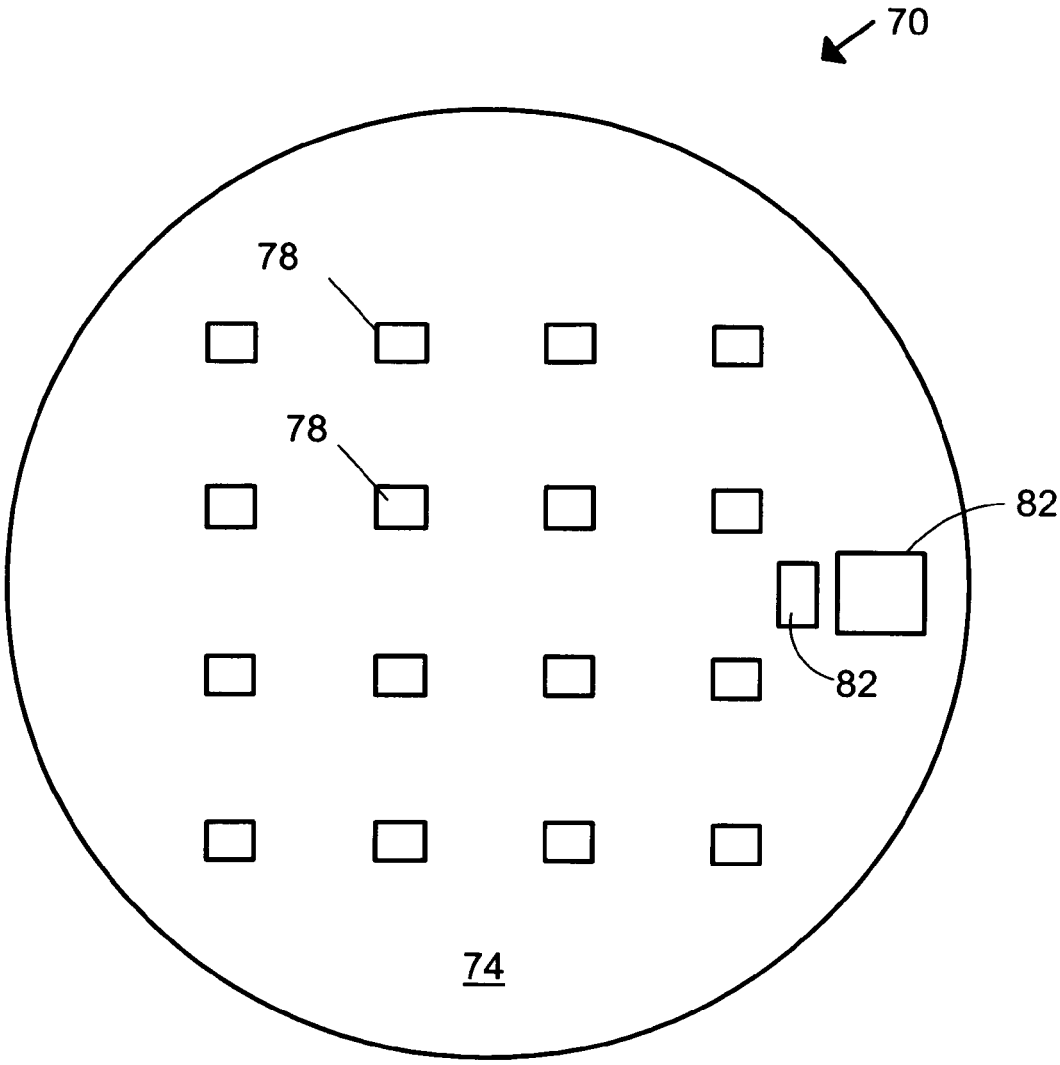
FIG. 4 is a diagram of a top view of an embodiment of the present invention.

Reference is now made to FIG. 4 where there is shown a top view of a sensor apparatus 70 with the contact plate removed so as to reveal the surface of spacer 74. The sensor apparatus shown in FIG. 4 is essentially the same as that shown in FIG. 3A with the exception that contact plate 24 has been removed to show the locations 78 for an array of sensors and the locations 82 of the electronics components according to one embodiment of the present invention.

Figure 5:
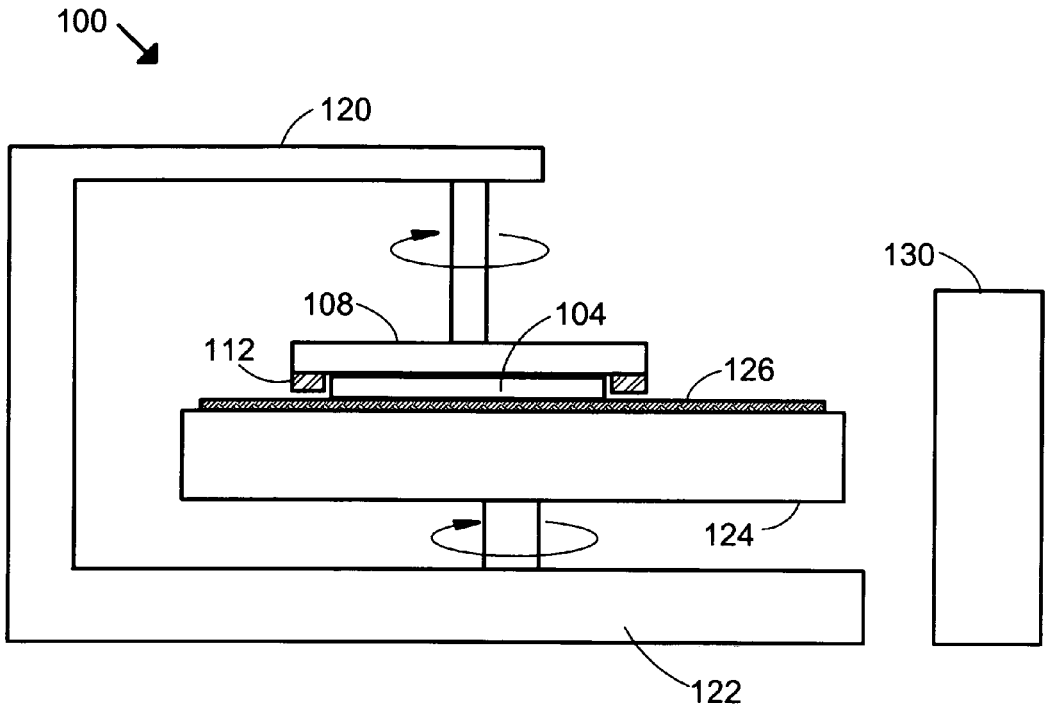
FIG. 5 is a diagram showing a side view of an embodiment of the present invention.

Reference is now made to FIG. 5 wherein there is shown a diagram of an embodiment 100 of the present invention that includes a CMP process tool and a sensor apparatus 104. The CMP process tool can be substantially any of the commercially available CMP process tools offered by a variety of vendors. The sensor apparatus 104 represents any of the sensor apparatus embodiments of the present invention such as those embodiments described in FIGS. 1A, 2A, 3A, 3C, 3E, and 3G.

The CMP process tool shown in FIG. 5 includes a wafer carrier 108 with retaining ring 112. Wafer carrier 108 is rotatably coupled to support arm 120 which is connected to the main CMP tool structure 122. The process tool further includes a platen 124 that is supported by and rotatably coupled to tool structure 122. CMP pad 126 is shown supported on platen 124. FIG. 5 also shows sensor apparatus 104 held by wafer carrier 108 so as to contact pad 126. Typical CMP tools include a robot 130 configured for loading and unloading wafers; sensor apparatus 104 is configured so that the sensor apparatus can be loaded and unloaded using the robot.

Another embodiment of the present invention includes a method of operating and maintaining a tool for CMP. The method comprises the steps of: Providing a CMP tool having a robot for transferring a workpiece from a storage container or chamber to a CMP workpiece holder. Providing a sensor apparatus configured for measuring at least one characteristic such as pressure or force distribution of a CMP process. The sensor apparatus has dimensions and physical properties that are substantially equal to the dimensions and physical properties of the workpiece. Using the robot to transfer a workpiece from the storage container to the holder for performing a CMP process and unloading the workpiece from the holder back to the storage container or chamber. Using the robot to transfer the sensor apparatus to the holder for performing the CMP process. Using the sensor apparatus to measure the at least one characteristic during the CMP process, and unloading the sensor apparatus from the holder using the robot. In a preferred embodiment, the sensor apparatus is configured for measuring pressure distributions or pressure trajectories.

In another embodiment of the present invention, the sensor apparatus is configured for measuring temperature distributions. In other words, the sensors in the sensor apparatus include an array of temperature sensors. In another preferred embodiment, the sensor apparatus is configured for measuring pressure distributions and temperature distributions. In other words, the sensors in the sensor apparatus include an array of pressure sensors and an array of temperature sensors.

It will be clear to those of ordinary skill in the art that the present disclosure allows modifications that result in additional embodiments of the present invention. In a preferred embodiment of the present invention intended for use for monitoring dielectric CMP applications, the contact plate comprises a silica, quartz, or borosilicate plate 200 mm in diameter and ~0.7 mm thick. In another preferred embodiment intended for use in monitoring copper CMP processes, the contact plate is composed of copper.

In one preferred embodiment of the present invention, a low adhesion bonding layer is used between the contact plate and the printed circuit board. This bonding layer comprises a Heat Sensitive Release material such as FA-1450-10TW from Grinding and Dicing Services, Inc. Heating this material to temperatures in excess of ~100° C. releases the contact plate from the printed circuit board and allows the contact plate to be replaced as necessary. This low adhesion layer is typically 0.1 mm to 0.3 mm in thickness in one embodiment of the present invention.

A variety of pressure sensors can be used for embodiments of the present invention. In a preferred embodiment, the sensors are pressure sensors such as the Intersema MS5535A available from Intersema Sensoric SA of Bevaix, Switzerland.

A variety of choices also exists for the type of printed circuit board used in embodiments of the present invention. Primarily, the printed circuit board provides electrical interconnections between the sensors and the electronics components in the sensor apparatus. The printed circuit board may be fabricated from commonly used printed circuit board materials such as FR4 epoxy fiberglass or flexible circuit board such as those made using polyimide polymer. In a preferred embodiment, the printed circuit board is approximately the same diameter as the contact plate and typically 0.25 to 0.75 mm in thickness. In a preferred embodiment, the PCB component includes a hole or other opening in close proximity to each pressure sensor. The hole allows the pressure sensor to be encapsulated with a liquid-like gel as indicated below and also assists in the accurate communication of pressure from the contact plate to the pressure sensor.

For some embodiments of the present invention, the thickness of the spacer material is selected based upon the height of the electronics components mounted upon the printed circuit board. Preferably, the spacer is securely bonded or laminated to the printed circuit board. In one embodiment, the spacer comprises a polyurethane polymer approximately 3 mm thick.

Preferably, the spacer cavities surrounding the sensors are filled with a liquid like gel material such as Dow Corning Sylgard 527. The function of this liquid-like gel material is to efficiently and accurately transmit pressure applied to connect the contact plate to the pressure sensor. It is a specific feature of a preferred embodiment that the liquid-like gel material and cavity filling method are optimized to provide for stable, hysterisis free communication of pressure.

In a preferred embodiment of the present invention, the base comprises a 0.25 mm thick polycarbonate sheet. Preferably, the base is securely bonded or laminated to the spacer.

As temperature or temperature changes can affect both the pressure sensors themselves and modify the properties of the surrounding materials, it is advantageous to incorporate one or more temperature sensors as part of the sensor apparatus used for measuring pressure. In other words, preferred embodiments of the present invention include having one or more of the sensors, such as sensors 40 in the figures, configured for temperature measurement. Examples of suitable sensors for temperature measurement can be found in U.S. Pat. No. 6,691,068 and U.S. Pat. No. 6,542,835 which are incorporated herein by this reference.

For preferred embodiments of the present invention, the sensor apparatus is configured so that the pressure measurements are absolute rather than relative. Preferably, the pressure sensors incorporate an internal vacuum reference. As an option for some embodiments of the present invention, the at least one sensor comprises a plurality of pressure sensors, and the pressure sensors comprise silicon diaphragms and contain a reference vacuum cavity. As another alternative for embodiments of the present invention, the at least one sensor comprises a plurality of pressure sensors, and the pressure sensors comprise silicon diaphragms that include an integral strain measuring resistive bridge.

For one embodiment of the present invention, the sensor apparatus comprises a silicon wafer like disk approximately 5 mm thick containing a plurality of pressure sensors and the supporting electronic components for powering, control, and communications electronics. The sensor apparatus can be put through a normal or predetermined CMP process and acquire data related to the temporal and spatial distribution of pressures during the CMP process. This data may then be used for a variety of purposes such as process optimization, process monitoring, and fault detection/identification. It is to be understood that the construction method and the style used to integrate and encapsulate the system components may be further modified to yield a substantially thinner sensor apparatus, perhaps even approximating the thickness of a silicon wafer used for device fabrication. An embodiment of such a sensor apparatus could be accomplished with the incorporation of MEMS integrated cavities and pressure sensors combined with hybrid electronic packaging.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

While there have been described and illustrated specific embodiments of the invention, it will be clear that variations in the details of the embodiments specifically illustrated and described may be made without departing from the true spirit and scope of the invention as defined in the appended claims and their legal equivalents.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," "includes," "including," "has," "having," "at least one of," or any other variation thereof, are intended to cover a non-exclusive inclusion. For example, a process, method, article, or apparatus that comprises a list of elements is not necessarily limited only to those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

What is claimed is:

1. A sensor apparatus comprising:

A. a contact plate having a contact surface for undergoing at least one of
   i. planarization and
   ii. polishing
   and a back side;

B. at least one sensor connected with the contact plate so as to measure pressure or force applied to the contact surface of the contact plate;

C. at least one electronics component coupled to the sensor so as to receive signals from the at least one sensor; and D. a base joined with the back side of the contact plate and configured so that the at least one sensor and the at least one electronic component are sandwiched between the contact plate and the base so as to be substantially isolated from process chemicals.

2. A sensor apparatus according to claim 1 wherein the contact plate comprises a sheet of metal.

3. A sensor apparatus according to claim 1 wherein the contact plate comprises a material used in the fabrication of integrated circuits.

4. A sensor apparatus according to claim 1 wherein the contact plate comprises a sheet of tungsten, a sheet of aluminum alloy, a sheet of silicon dioxide, a sheet of boron phosphorous silicate glass, a sheet of fluorine doped silicon dioxide, a sheet of diamond like carbon, a sheet of diamond, a sheet of carbon doped silicon dioxide, a sheet of silicon, a sheet of fused silica, a sheet of quartz, a sheet of borosilicate glass, a sheet of alumina, a sheet of sapphire, or a sheet of a low dielectric constant silicon compound.

5. A sensor apparatus according to claim 1 wherein the contact plate comprises a supported layer of tungsten, a supported layer of aluminum alloy, a supported layer of silicon dioxide, a supported layer of boron phosphorous silicate glass, a supported layer of fluorine doped silicon dioxide, a supported layer of diamond like carbon, a supported layer of diamond, a supported layer of carbon doped silicon dioxide, a supported layer of silicon, a supported layer of fused silica, a supported layer of quartz, a supported layer of borosilicate glass, a supported layer of alumina, a supported layer of sapphire, or a supported layer of a low dielectric constant silicon compound.

6. A sensor apparatus according to claim 1 wherein the contact surface comprises copper.

7. A sensor apparatus according to claim 1 wherein the contact surface comprises a material having a dielectric constant less than about 2.1.

8. A sensor apparatus according to claim 1 wherein the contact surface includes a surface topography for being planarized.

9. A sensor apparatus according to claim 1 wherein the contact surface is substantially smooth and substantially flat.

10. A sensor apparatus according to claim 1 wherein the contact surface includes a surface topography used in the fabrication of an integrated circuit.

11. A sensor apparatus according to claim 1 further comprising an adhesive between the backside of the contact plate and the base, the adhesive being applied so as to join the base to the contact plate.

12. A sensor apparatus according to claim 1 further comprising a spacer for substantially filling voids between the backside of the contact plate and the base, the spacer being substantially incompressible.

13. A sensor apparatus according to claim 1 further comprising a force transmitting medium, the force transmitting medium being disposed so as to transmit force from the contact plate to the at least one sensor.

14. A sensor apparatus according to claim 1 further comprising a force transmitting medium, the force transmitting medium being disposed so as to transmit force from the contact plate to the at least one sensor, the medium comprising a gel.

15. A sensor apparatus according to claim 1 further comprising a force transmitting medium, the force transmitting medium being disposed so as to transmit force from the contact plate to the at least one sensor, the medium comprising a solid.

16. A sensor apparatus according to claim 1 further comprising a printed circuit board interconnecting the at least one sensor and the at least one electronic component, the printed circuit board being sandwiched between the contact plate and the base.

17. A sensor apparatus according to claim 16 further comprising an adhesive between the backside of the contact plate and the printed circuit board, the adhesive being applied so as to affix the printed circuit board to the contact plate; the printed circuit board having a through hole proximate the sensor; the through hole being capable of providing fluid communication between the contact plate and the sensor.

18. A sensor apparatus according to claim 17 wherein the adhesive comprises a removable adhesive between the backside of the contact plate and the printed circuit board, the adhesive being applied so as to detachably affix the printed circuit board to the contact plate.

19. A sensor apparatus according to claim 1 wherein the at least one sensor comprises a plurality of pressure sensors disposed so as to be capable of measuring spatial pressure distributions for the contact surface.

20. A sensor apparatus according to claim 1 wherein the at least one sensor comprises a plurality of pressure sensors disposed so as to be capable of measuring spatial pressure distributions for the contact surface and at least one temperature sensor for measuring a temperature representing a temperature of the contact surface.

21. A sensor apparatus according to claim 1 wherein the at least one sensor comprises a plurality of pressure sensors disposed so as to be capable of measuring spatial pressure distributions for the contact surface and a plurality of temperature sensors disposed so as to be capable of measuring spatial temperature distributions for the contact surface.

22. A sensor apparatus according to claim 1 wherein the at least one electronic component is capable of at least one of storing data from the at least one sensor, transmitting data, and executing computer commands.

23. A sensor apparatus according to claim 1 wherein the at least one electronic component is capable of wirelessly transmitting data and wirelessly receiving commands.

24. A sensor apparatus according to claim 1 wherein the at least one electronic component comprises an information processor.

25. A sensor apparatus according to claim 1 wherein the contact plate comprises a substantially whole semiconductor wafer.

26. The apparatus of claim 1 wherein the at least one sensor comprises a plurality of pressure sensors, the sensor apparatus having a plurality of cavities, the pressure sensors are contained within the cavities, the cavities containing a low modulus gel or a liquid.

27. The apparatus of claim 1 wherein the at least one sensor comprises a plurality of pressure sensors, the pressure sensors comprise silicon diaphragms that include an integral strain measuring resistive bridge.

28. The apparatus of claim 1 wherein the at least one sensor comprises a plurality of pressure sensors, the pressure sensors comprise silicon diaphragms and contain a reference vacuum cavity.

29. A sensor apparatus for measuring spatially resolved process conditions for chemical mechanical planarization of substrates, the substrates having a mechanical stiffness, the sensor apparatus comprising:

A. a contact plate having a contact surface for undergoing chemical mechanical planarization and a back side;

B. a plurality of sensors connected with the contact plate so as to measure process conditions for the contact plate;

C. a filler disposed between the contact plate and the sensors;

D. at least one electronics component coupled to the sensors so as to receive signals from the sensors;

E. a printed circuit board for interconnecting the sensors and the at least one electronics component;

F. a base joined with the back side of the contact plate and configured so that the sensors, the at least one electronics component, and the printed circuit board are sandwiched between the contact plate and the base;

G. a spacer for substantially filling the space between the printed circuit board, the at least one electronics component and the base; and wherein, the sensor apparatus is configured so as to have a mechanical stiffness substantially equal to the mechanical stiffness of the substrates.

30. A sensor apparatus according to claim 29 wherein the plurality of sensors comprises temperature sensors.

31. A sensor apparatus according to claim 29 wherein the plurality of sensors comprises pressure sensors.

32. A sensor apparatus according to claim 29 wherein the plurality of sensors comprises temperature sensors and pressure sensors.

33. A sensor apparatus according to claim 29 wherein the filler and the spacer have substantially the same material properties.

* * * * *